US006840617B2

(12) United States Patent
Crosby et al.

(10) Patent No.: US 6,840,617 B2
(45) Date of Patent: Jan. 11, 2005

(54) MID-FRAME FOR AN IMAGING APPARATUS

(75) Inventors: Nathan Edward Crosby, Independence, KY (US); Daniel Robert Gagnon, Harrodsburg, KY (US); Mark Aaron Neal, Lexington, KY (US); Jennifer Christina Williams, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/114,194

(22) Filed: Apr. 2, 2002

(65) Prior Publication Data

US 2003/0184634 A1 Oct. 2, 2003

(51) Int. Cl.[7] ..... B41J 2/01; B41J 2/165

(52) U.S. Cl. ..... 347/104; 347/36

(58) Field of Search ..... 347/30, 31, 36, 347/102, 104

(56) References Cited

U.S. PATENT DOCUMENTS

| | | | | | |
|---|---|---|---|---|---|
| 4,024,548 | A | | 5/1977 | Alonso et al. | 347/34 |
| 4,520,366 | A | | 5/1985 | Cragin, Jr. | 347/74 |
| 4,577,198 | A | | 3/1986 | Hibino et al. | 347/197 |
| 4,636,809 | A | | 1/1987 | Eremity | 347/90 |
| 4,839,664 | A | | 6/1989 | Archer et al. | 347/90 |
| 4,929,966 | A | | 5/1990 | Sexton et al. | 347/90 |
| 4,933,726 | A | | 6/1990 | Moriyama | 399/405 |
| 4,975,780 | A | | 12/1990 | Kuboki | 347/104 |
| 5,105,205 | A | | 4/1992 | Fagerquist | 347/90 |
| 5,132,817 | A | * | 7/1992 | Inaba | 345/94 |
| 5,196,863 | A | | 3/1993 | Palmer et al. | 347/171 |
| 5,291,227 | A | * | 3/1994 | Suzuki | 347/104 |
| 5,393,151 | A | | 2/1995 | Martin et al. | 400/642 |
| 5,419,644 | A | | 5/1995 | Martin et al. | 400/642 |
| 5,469,202 | A | | 11/1995 | Stephens | 347/90 |
| 5,515,094 | A | | 5/1996 | Tanaka et al. | 347/104 |
| 5,564,847 | A | | 10/1996 | Patrick et al. | 400/642 |
| 5,683,187 | A | | 11/1997 | Tunmore | 400/58 |
| 5,771,052 | A | | 6/1998 | Hine et al. | 347/42 |
| 5,854,643 | A | | 12/1998 | Katsuyama | 347/8 |
| 5,874,979 | A | | 2/1999 | Ohyama | 347/104 |
| 5,887,987 | A | | 3/1999 | Sawano | 400/56 |
| 5,951,181 | A | | 9/1999 | Hierro et al. | 400/645 |
| 5,992,994 | A | | 11/1999 | Rasmussen et al. | 347/104 |
| 5,997,129 | A | | 12/1999 | Matsuhashi | 347/35 |
| 6,102,590 | A | | 8/2000 | Harris et al. | 400/56 |
| 6,113,289 | A | | 9/2000 | Saito et al. | 400/58 |
| 6,220,693 | B1 | | 4/2001 | Bode et al. | 347/34 |
| 6,234,620 | B1 | | 5/2001 | Faisst, Jr. et al. | 347/90 |
| 6,239,817 | B1 | | 5/2001 | Meyer | 347/36 |
| 6,281,911 | B1 | | 8/2001 | Nakazawa et al. | 347/36 |
| 6,312,094 | B1 | | 11/2001 | Ito et al. | 347/36 |
| 6,352,333 | B1 | * | 3/2002 | Matsumoto et al. | 347/23 |
| 2002/0044165 | A1 | | 4/2002 | Otsuki | 347/5 |
| 2002/0070991 | A1 | | 6/2002 | Otsuki | 347/16 |
| 2002/0070994 | A1 | | 6/2002 | Otsuki | 347/19 |

FOREIGN PATENT DOCUMENTS

| | | | |
|---|---|---|---|
| JP | 2000118058 | * | 4/2000 |

* cited by examiner

*Primary Examiner*—Michael S. Brooke
(74) *Attorney, Agent, or Firm*—Taylor & Aust, P.C.

(57) ABSTRACT

A mid-frame for use in an imaging apparatus includes an undulating surface extending in an undulation direction. At least one elongated slot can be formed in the mid-frame, wherein a direction of elongation of the elongated slot is substantially the same direction as the undulation direction.

54 Claims, 4 Drawing Sheets

MID-FRAME FOR AN IMAGING APPARATUS

BACKGROUND OF THE INVENTION

1. Field of the Invention

The present invention relates to an imaging apparatus, and, more particularly, to a mid-frame for use with an imaging apparatus.

2. Description of the Related Art

With the advent of edge-to-edge printing, also known as borderless printing, various attempts have been made to reduce the occurrence of ink contamination of the printer mid-frame. As used herein, the term "mid-frame" refers to the supporting structure of the printer positioned opposed to the printing mechanism to provide support for the printing medium. In an ink jet printer, the printing mechanism is typically a printhead including a plurality of ink jetting nozzles.

A typical ink jet printer forms an image on a print medium by ejecting ink from the plurality of ink jetting nozzles to form a pattern of ink dots on the print medium. The printhead may include a plurality of nozzle arrays, such as a cyan array, a magenta array, and a yellow array, arranged as a longitudinal column of nozzle arrays. Such an arrangement of nozzle arrays will be referred to herein as "stacked nozzle arrays."

Such an ink jet printer typically includes a reciprocating printhead carrier that transports one or more ink jet printheads across the print medium along a bi-directional scanning path defining a print zone of the printer. Typically, the mid-frame provides media support at or near the print zone. The bi-directional scanning path is oriented parallel to a main scan direction, also commonly referred to as the horizontal direction. The main scan direction is bi-directional. During each scan of the printhead carrier, the print medium is held stationary. An indexing mechanism is used to incrementally advance the print medium in a sheet feed direction, also commonly referred to as a sub-scan direction or vertical direction, through the print zone between scans in the main scan direction, or after all data intended to be printed with the print medium at a particular stationary position has been completed.

During printing, if wet ink accumulates on the mid-frame, then a subsequent sheet of print media will contact the accumulated ink, thereby smearing ink on the underside of the sheet of print media. In a conventional ink jet printer that does not accommodate edge-to-edge printing, the print engine controls printing so as to prevent the ejection of ink onto the leading, trailing, and side edge portions of the sheet of print media. In this manner, sheet margins are created on the medium sheet, which in turn protect the upper surface of the supporting mid-frame from ink contamination.

In order to accommodate edge-to-edge printing in the conventional printer, special media can be used that includes perforated tabs. With this arrangement, if a user desired a borderless print, the user would merely separate the perforated tab from the remaining portion of the medium stock carrying the print image.

In order to avoid the necessity of using special print media, further attempts have been made to accommodate edge-to-edge printing using regular, non-perforated, print media. One such attempt is to provide a hollowed out area located in the mid-frame in a region opposite to the printhead to collect ink that is discharged at the leading and trailing edge portions of the sheet of print media. An absorbent material is located in the hollowed out area to absorb the ink ejected thereon. A front set and a rear set of upstanding cockle ribs are positioned on each side of the hollowed out area, respectively, and extend upwardly from the mid-frame a sufficient distance to substantially prevent either a leading edge or a trailing edge of a sheet of print medium traveling across a print zone within the printer from making contact with the absorbent material. As the longitudinal extent of the printhead increases to accommodate more printing nozzles, such as in the case of stacked nozzle arrays, such a mid-frame design requires that the trough become wider. However, as the trough becomes wider, the risk that the sheet will bow and contact the accumulated waste ink increases.

What is needed in the art is a mid-frame design having improved surface characteristics. Preferably, such a mid-frame can accommodate edge-to-edge printing, and can accommodate printheads, for example having stacked nozzle arrays, without widening the extent of an individual waste ink collection opening in the mid-frame in a sheet feed direction.

SUMMARY OF THE INVENTION

The present invention provides a mid-frame design having improved surface characteristics. In a preferred embodiment, the mid-frame can accommodate edge-to-edge printing, and can accommodate printheads, for example having stacked nozzle arrays, without widening the extent of an individual waste ink collection opening in the sheet feed direction.

In one form thereof, the present invention relates to a mid-frame for use in an imaging apparatus, the imaging apparatus defining a sheet feed direction. The mid-frame includes a mid-frame surface for supporting a print medium sheet. The mid-frame includes a first opening for receiving first waste ink, and a second opening spaced from the first opening in the sheet feed direction, the second opening for receiving second waste ink.

In another form thereof, the present invention relates to a mid-frame for use in an imaging apparatus, wherein the mid-frame includes an undulating surface for supporting a print medium sheet. The undulating surface is oriented so that the undulating occurs in an undulation direction substantially perpendicular to a sheet feed direction.

In still another form thereof, the present invention relates to a mid-frame for use in an imaging apparatus. The mid-frame includes an undulating surface extending in an undulation direction. At least one elongated slot is formed in the mid-frame, wherein a direction of elongation of the elongated slot is substantially the same direction as the undulation direction.

BRIEF DESCRIPTION OF THE DRAWINGS

The above-mentioned and other features and advantages of this invention, and the manner of attaining them, will become more apparent and the invention will be better understood by reference to the following description of one embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
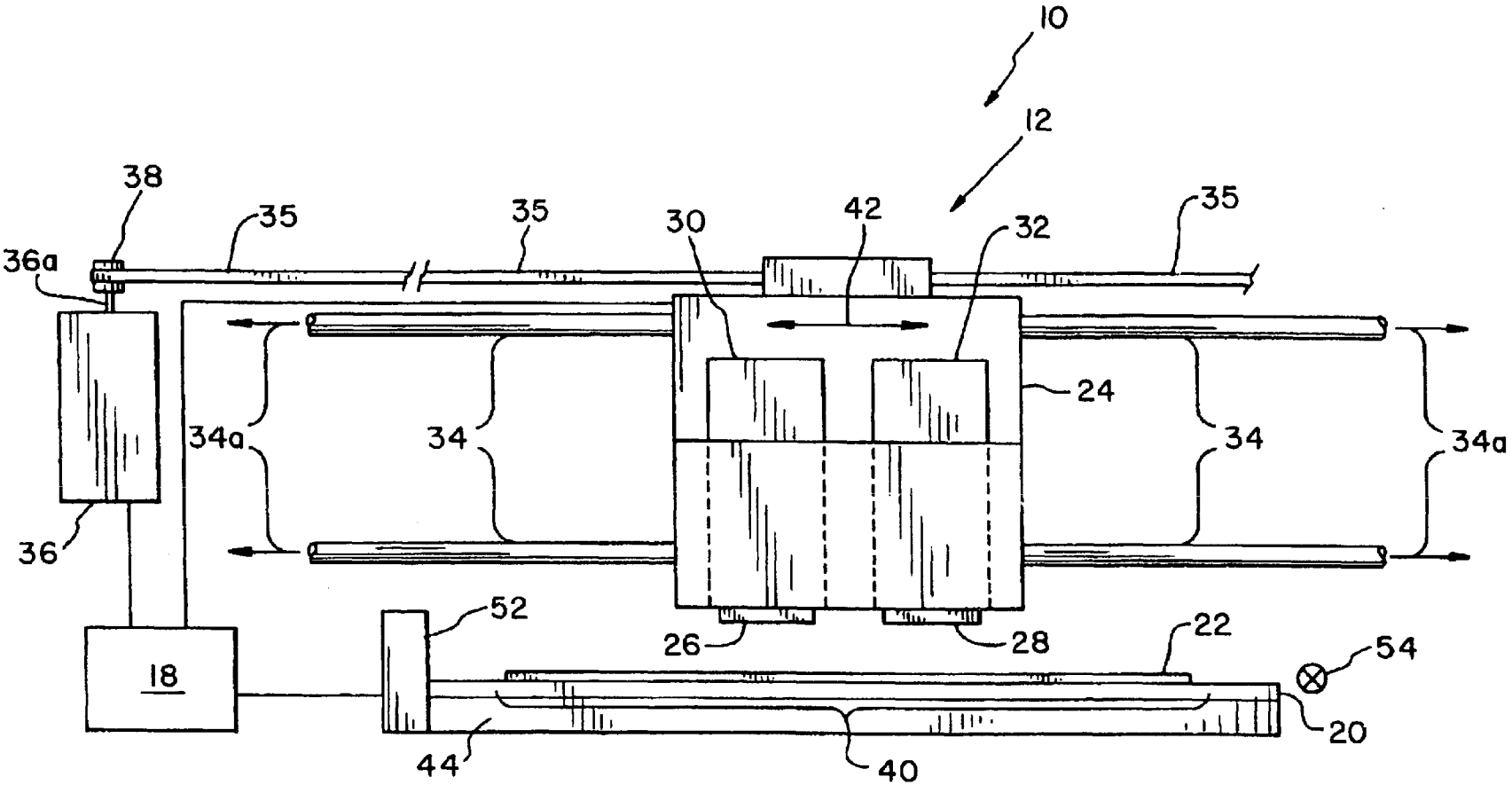
FIG. 1 is a pictorial representation of a portion of an ink jet printer.
Figure 2:
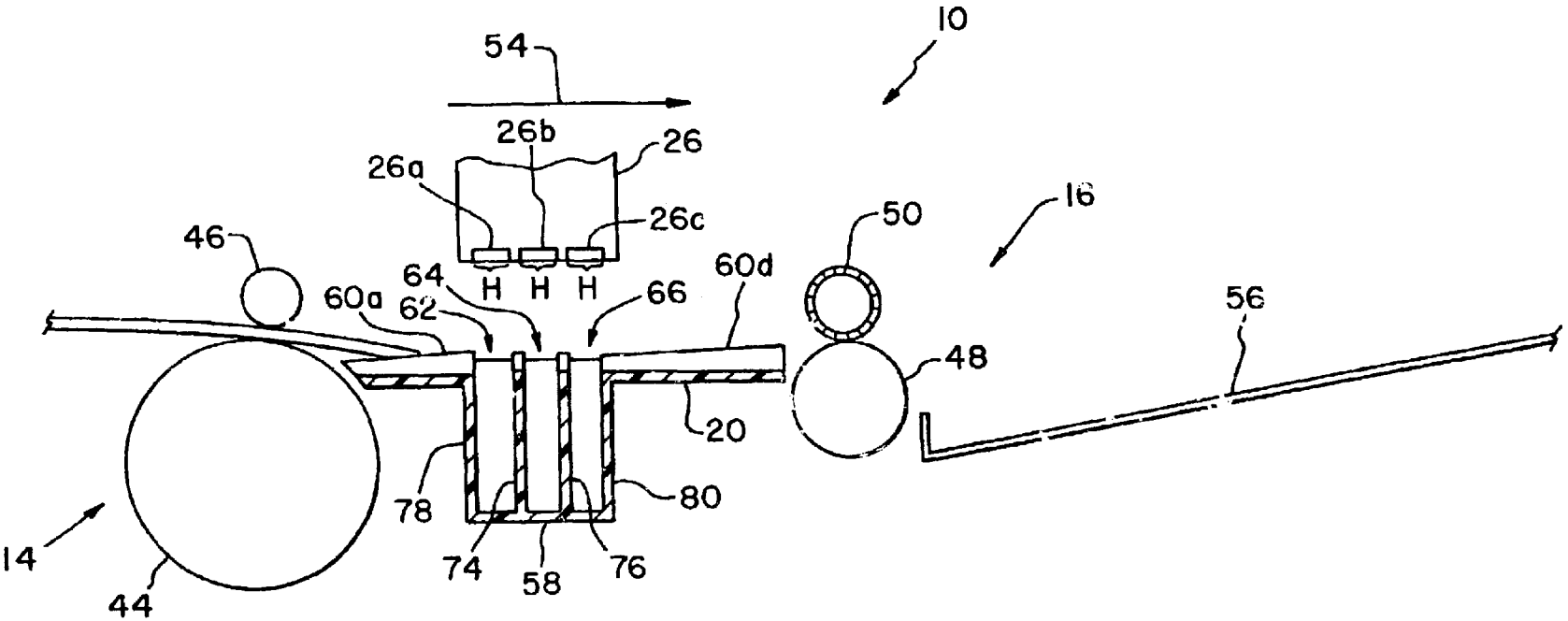
FIG. 2 is a pictorial representation of a side view of the ink jet printer of FIG. 1, wherein the mid-frame is shown in section.

Referring now to the drawings and particularly to FIGS. 1 and 2, there is shown a printer 10 including a printhead carrier system 12, a feed roller unit 14, an exit roller unit 16, a controller 18 and a mid-frame 20. Controller 18, which includes a microprocessor with associated random access memory (RAM) and read only memory (ROM), executes program instructions to effect the generation of control signals which are supplied to printhead carrier system 12, feed roller unit 14, and exit roller unit 16 to effect the printing of an the image on a print medium sheet 22, such as paper.

Printhead carrier system 12 includes a printhead carrier 24 for carrying a color printhead 26 and a black printhead 28. A color ink reservoir 30 is provided in fluid communication with color printhead 26, and a black ink reservoir 32 is provided in fluid communication with black printhead 28. Printhead carrier system 12 and printheads 26, 28 may be configured for unidirectional printing or bi-directional printing.

Printhead carrier 24 is guided by a pair of guide rods 34. The axes 34*a* of guide rods 34 define a bi-directional scanning path for printhead carrier 24, and thus, for convenience the bi-directional scanning path will be referred to as bi-directional scanning path 34*a*. Printhead carrier 24 is connected to a carrier transport belt 35 that is driven by a carrier motor 36 via driven pulley 38 to transport printhead carrier 24 in a reciprocating manner along guide rods 34. Carrier motor 36 can be, for example, a direct current (DC) motor or a stepper motor. Carrier motor 36 has a rotating carrier motor shaft 36*a* that is attached to carrier pulley 38.

The reciprocation of printhead carrier 24 transports ink jet printheads 26, 28 across a print medium sheet 22, such as paper, along bi-directional scanning path 34*a* to define a print zone 40 of printer 10. This reciprocation occurs in a main scan direction 42 that is parallel with bi-directional scanning path 34*a*, and is also commonly referred to as the horizontal direction. During each scan of printhead carrier 24, print medium sheet 22 is held stationary by feed roller unit 14 and/or exit roller unit 16.

Feed roller unit 14 includes an index roller 44 and a corresponding index pinch roller 46. Exit roller unit 16 includes an exit roller 48 and a corresponding exit pinch roller 50. In the embodiment shown, index roller 44 and exit roller 48 are driven rollers that are driven by a drive unit 52. Pinch rollers 46 and 50 are idler rollers, and apply a biasing force to hold the print medium sheet 22 in contact with their respective driven rollers 44, 48. Drive unit 52 includes a drive source, such as a stepper motor, and an associated drive mechanism, such as a gear train or belt/pulley arrangement.

During operation, index roller 44 incrementally advances print medium sheet 22 in a sheet feed direction 54, toward and into a print zone 40 across mid-frame 20. As shown in FIG. 1, sheet feed direction 54 is depicted as an X within a circle to indicate that the sheet feed direction is in a direction perpendicular to the plane of FIG. 1, toward the reader. Sheet feed direction 54 is substantially perpendicular to main scan direction 42, and in turn, substantially perpendicular to bi-directional scanning path 34*a*. Once print medium sheet 22 is released from the nip formed by index roller 44 and index pinch roller 46, exit roller 48 is controlled to continue the incremental advancement of print medium sheet 22 through print zone 40, and ultimately expels print medium sheet 22 into an exit tray 56.

Figure 3:
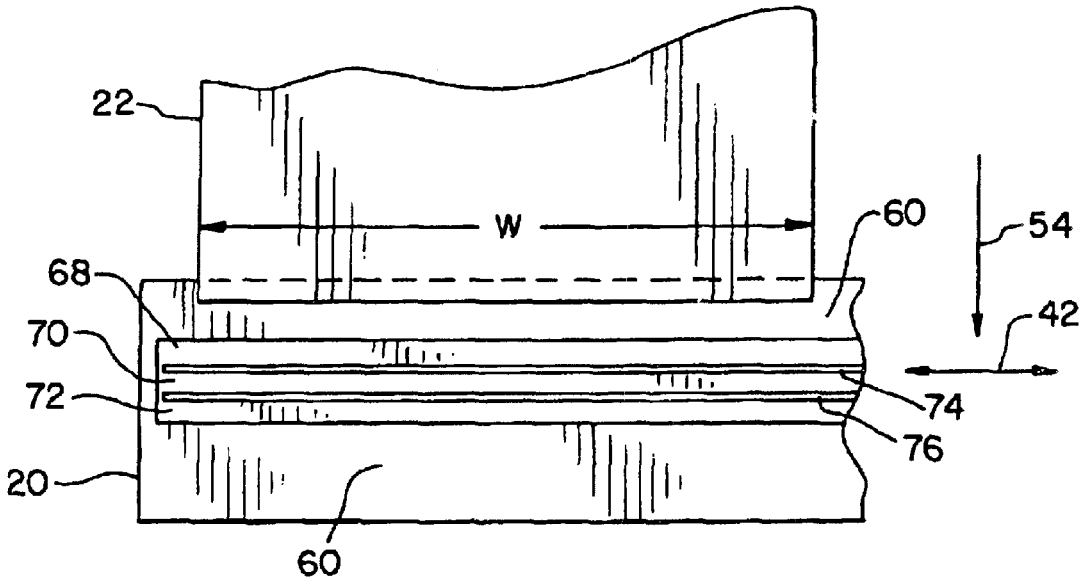
FIG. 3 is a top view of the mid-frame of FIG. 2.
Figure 4:
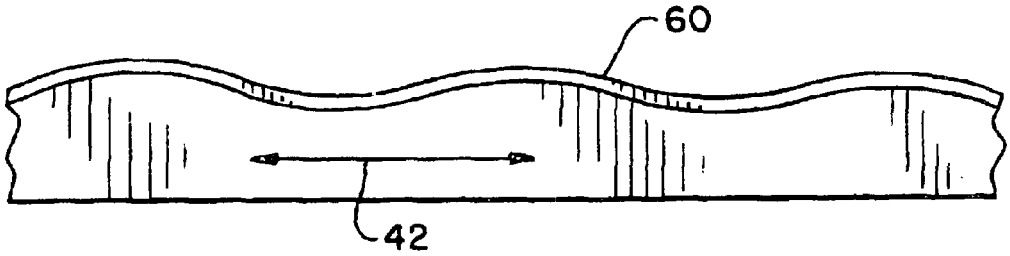
FIG. 4 is an end view of the mid-frame of FIG. 2.

Referring now to FIGS. 2, 3 and 4, mid-frame 20 includes a base 58, a mid-frame surface 60, a first trough 62, a second trough 64 and a third trough 66.

Mid-frame surface 60 provides support for print medium sheet 22 as print medium sheet 22 is transported through print zone 40 by index roller 44 and/or exit roller 48.

First trough 62 defines a first opening 68 for receiving and collecting waste ink ejected from printhead nozzle array 26*a*, for example a cyan array, that is not ejected on print medium sheet 22. Second trough 64 is spaced from first trough 62 in sheet feed direction 54, and defines a second opening 70 for receiving and collecting waste ink ejected from printhead nozzle array 26*b*, for example a magenta array, that is not ejected on print medium sheet 22. Third trough 66 is spaced from second trough 64 in sheet feed direction 54, and defines a third opening 72 for receiving and collecting waste ink ejected from printhead nozzle array 26*c*, for example a yellow array, that is not ejected on print medium sheet 22.

As shown in FIG. 3, each of first opening 68, second opening 70 and third opening 72 may be formed as an elongated slot, with the direction of elongation corresponding to main scan direction 42. Preferably, an extent of each of first opening 68, second opening 70 and third opening 72 in main scan direction 42 is longer than a width W of print medium sheet 22 in main scan direction 42. Also, an extent of each of first opening 68, second opening 70 and third opening 72 in sheet feed direction 54 is slightly wider than a height H of the corresponding printhead nozzle array 26*a*, 26*b* and 26*c*, respectively, in sheet feed direction 54.

Referring to FIGS. 2 and 3, first trough 62, second trough 64 and third trough 66 extend upwardly from base 58. As shown, first opening 68 is separated from second opening 70 by a first partition 74 extending upwardly from base 58. Second opening 70 is separated from third opening 72 by a second partition 76 extending upwardly from base 58. Accordingly, trough 62 is defined by base 58, first partition 74 and a first wall 78; trough 64 is defined by base 58, first partition 74 and second partition 76; and, trough 66 is defined by second partition 76 and a second wall 80. It is recognized that troughs 62, 64, 66 may have a common sidewalls, as shown in FIG. 3. Alternatively, individual sidewalls can be provided for each of troughs 62, 64, 66.

Figure 5:
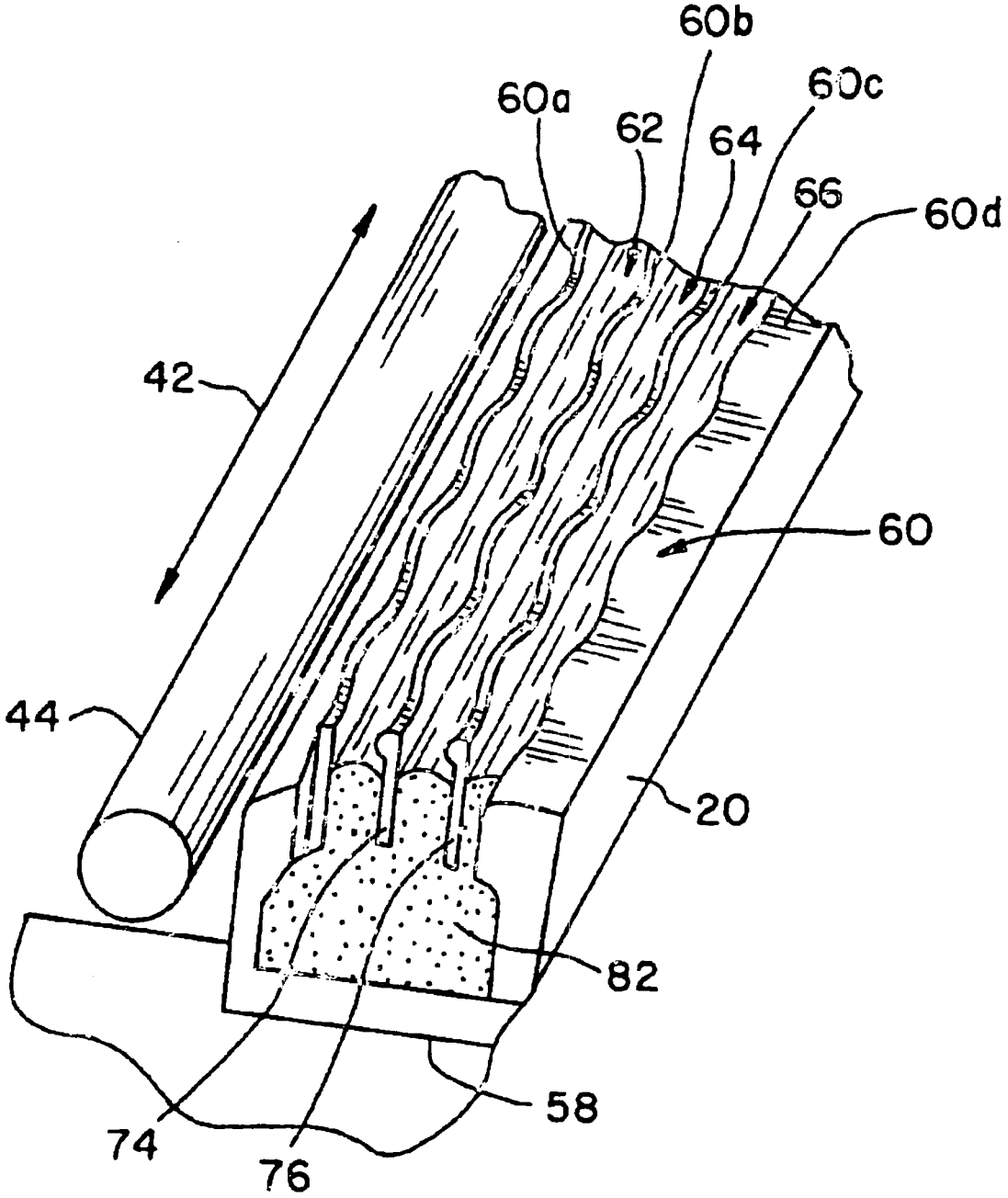
FIG. 5 is a perspective view of the mid-frame of FIG. 2.

As shown in FIG. 5, one or more of troughs 62, 64, 66 can have positioned therein an absorption pad 82 having hydrophilic properties for absorbing waste inks received into the respective troughs. In a preferred embodiment, each of troughs 62, 64, 66 include an absorption pad, such as absorption pad 82.

Mid-frame surface 60, which is continuous in main scan direction 42, is interrupted in sheet feed direction 54 by first opening 68, second opening 70 and third opening 72 to define a plurality of mid-frame surface sections 60*a*, 60*b*, 60*c* and 60*d* (see FIG. 5). As can be best seen in FIGS. 4 and 5, mid-frame surface 60, excluding first opening 68, second opening 70 and third opening 72, defines a undulating surface that undulates in an undulation direction corresponding to main scan direction 42. A profile of undulating mid-frame surface 60, as shown in FIG. 4, has a substantially sinusoidal shape. However, it is contemplated as a part of the invention that other profiles having a mathematically continuous shape, i.e., not having a portion having an infinite slope, could be substituted for the sinusoidal shape. Also, it is contemplated that portions of the continuous undulation in the undulation direction 42 could be replaced with one or more regions of discontinuity.

In the preferred embodiment as shown FIGS. 2 and 5, mid-frame surface sections 60*a*, 60*b*, 60*c* and 60*d* of mid-frame surface 60 define continuous undulating surfaces. In addition, mid-frame surface sections 60*a*, 60*b*, 60*c* and 60*d* of mid-frame surface 60 can include an inclined portion, wherein the incline of the inclined portion rises in an inclination direction, corresponding to sheet feed direction 54. As shown, the undulating surface of mid-frame surface 60 comprises a substantial portion, e.g., greater than 80 percent, of a surface area of mid-frame 20. Also, as shown, the undulating surface of undulating mid-frame surface 60 is present on each side of openings 68, 70 and 72 in a direction substantially perpendicular to the undulation direction, i.e., in sheet feed direction 54.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A mid-frame for use in an imaging apparatus, said imaging apparatus defining a sheet feed direction, said mid-frame comprising a mid-frame surface for supporting a print medium sheet, said mid-frame including a first opening for receiving first waste ink, and a second opening spaced from said first opening in said sheet feed direction, said second opening for receiving second waste ink, wherein said mid-frame surface, excluding said first opening and said second opening, defines a continuous undulating surface having a constantly varying slope, said undulating occurring in an undulation direction substantially perpendicular to said sheet feed direction.

2. The mid-frame of claim 1, wherein said continuous undulating surface includes an inclined portion, wherein an incline of said inclined portion rises in said sheet feed direction.

3. The mid-frame claim 1, wherein each of said first opening and said second opening is an elongated slot having an extent in said direction substantially perpendicular to said sheet feed direction that is longer than a width of said print medium sheet.

4. The mid-frame of claim 1, wherein said mid-frame comprises:

a base; and a first partition extending upwardly from said base, said first opening being separated from said second opening by said first partition.

5. The mid-frame of claim 4, wherein said first partition includes a continuous undulating surface.

6. The mid-frame of claim 1, said mid-frame including a third opening spaced from said second opening in said sheet feed direction, said third opening for receiving a third waste ink.

7. The mid-frame of claim 6, wherein said mid-frame comprises:

a base;

a first partition extending upwardly from said base, said first opening being separated from said second opening by said first partition; and a second partition extending upwardly from said base, said second opening being separated from said third opening by said second partition.

8. The mid-frame of claim 1, wherein said mid-frame comprises:

a base;

a first partition extending upwardly from said base, said first opening being separated from said second opening by said first partition; and a second partition extending upwardly from said base, said second opening being separated from a third opening by said second partition, wherein a portion of said mid-frame surface defined by each of said first partition and said second partition is a continuous undulating surface.

9. The mid-frame of claim 8, wherein said portion is inclined.

10. A mid-frame for use in an imaging apparatus, said imaging apparatus defining a sheet feed, direction, said mid-frame comprising an continuous undulating surface having a constantly varying slope for supporting a print medium sheet, said undulating surface being oriented so that said undulating occurs in an undulation direction substantially perpendicular to said sheet feed direction.

11. The mid-frame of claim 10, wherein said undulating surface includes an inclined portion, wherein an incline of said inclined portion rises in an inclination direction substantially perpendicular to said undulation direction.

12. The mid-frame of claim 10, wherein said undulating surface is continuous and comprises a substantial portion of a surface area of said mid-frame.

13. The mid-frame of claim 10, wherein said mid-frame includes an opening for receiving waste ink.

14. The mid-frame of claim 13, wherein said opening is an elongated slot, said undulating surface being continuous in said undulation direction and being present on each side of said elongated slot in said sheet feed direction.

15. The mid-frame of claim 10, wherein said mid-frame includes a first opening and a second opening, said mid-frame comprising:

a base; and a partition extending upwardly from said base, wherein said first opening is separated from said second opening by said partition, and said partition defining a portion of said undulating surface.

16. The mid-frame of claim 15, wherein said portion is inclined.

17. The mid-frame of claim 15, wherein said undulating surface is interrupted in a direction perpendicular to said undulation direction by said first opening and said second opening.

18. The mid-frame of claim 10, wherein said mid-frame includes a first opening spaced from a second opening in said sheet feed direction, and a third opening spaced from a second opening in said sheet feed direction, said mid-frame comprising:

a base;

a first partition extending upwardly from said base, wherein said first opening is separated from said second opening by said first partition; and a second partition extending upwardly from said base, wherein said second opening is separated from said third opening by said second partition.

19. The mid-frame of claim 18, wherein a portion of said undulating surface is defined by each of said first partition and said second partition.

20. The mid-frame of claim 19, wherein said portion is inclined in said sheet feed direction.

21. The mid-frame of claim 10, wherein said continuous undulating surface has a substantially sinusoidal shape.

22. A mid-frame for use in an imaging apparatus, comprising: an continuous undulating surface having a constantly varying slope extending in an undulation direction; and at least one elongated slot formed in said mid-frame, wherein a direction of elongation of said elongated slot is substantially the same direction as said undulation direction.

23. The mid-frame of claim 22, wherein said undulating surface is present on each side of said opening in a second direction substantially perpendicular to said undulation direction.

24. The mid-frame of claim 22, wherein said undulating surface includes an inclined portion, wherein an incline of said inclined portion rises in an inclination direction substantially perpendicular to an undulation direction.

25. An imaging apparatus, comprising:

a printhead carrier;

a printhead coupled to said printhead carrier for controllably expelling ink in a print zone, said printhead being transported by said printhead carrier in a main scan direction;

a transport system for transporting a print medium sheet through said print zone in a sheet feed direction; and a mid-frame having a mid-frame surface for supporting said print medium sheet transported through said print zone by said transport system, said mid-frame including a first opening for receiving first waste ink not ejected on said print medium sheet, and a second opening spaced from said first opening in said sheet feed direction, said second opening for receiving second waste ink not ejected on said print medium sheet, wherein said mid-frame surface, excluding said first opening and said second opening, defines a continuous undulating surface, having a constantly varying slope, said undulating occurring in said main scan direction.

26. The imaging apparatus of claim 25, wherein said continuous undulating surface includes an inclined portion, wherein an incline of said inclined portion rises in said sheet feed direction.

27. The imaging apparatus of claim 25, wherein said continuous undulating surface comprises a substantial portion of a surface area of said mid-frame.

28. The imaging apparatus of claim 25, wherein an extent of each of said first opening and said second opening in said main scan direction is longer than a width of said print medium sheet in said main scan direction.

29. The imaging apparatus of claim 25, wherein said first opening is defined by a first trough, said first trough having positioned therein a first absorption pad for absorbing said first waste ink.

30. The imaging apparatus of claim 29, wherein said second opening is defined by a second trough, said second trough having positioned therein a second absorption pad for absorbing said second waste ink.

31. The imaging apparatus of claim 29, wherein said mid-frame comprises:

a base; and a first partition extending upwardly from said base, said first opening being separated from said second opening by said first partition.

32. The imaging apparatus of claim 31, wherein said first partition includes an undulating surface, said undulating occurring in said main scan direction.

33. The imaging apparatus of claim 25, said mid-frame including a third opening spaced from said second opening in said sheet feed direction, said third opening receiving a third waste ink not ejected on said print medium sheet.

34. The imaging apparatus of claim 33, wherein said mid-frame comprises:

a base; and a first partition extending upwardly from said base, said first opening being separated from said second opening by said first partition; and a second partition extending upwardly from said base, said second opening being separated from said third opening by said second partition.

35. The imaging apparatus of claim 34, wherein a portion of said mid-frame surface defined by each of said first partition and said second partition is an undulating surface, said undulating occurring in said main scan direction.

36. The imaging apparatus of claim 35, wherein said portion is inclined in said sheet feed direction.

37. The imaging apparatus of claim 33, wherein an extent of at least one of said first opening, said second opening and said third opening in said main scan direction is longer than a width of said print medium sheet in said main scan direction.

38. An imaging apparatus, comprising:

a printhead carrier;

a printhead coupled to said printhead carrier for controllably expelling ink in a print zone, said printhead being transported by said printhead carrier in a main scan direction;

a transport system for transporting a print medium sheet through said print zone in a sheet feed direction; and a mid-frame having an continuous undulating surface having a constantly varying slope, for supporting said print medium sheet transported through said print zone by said transport system, said undulating occurring in said main scan direction.

39. The imaging apparatus of claim 38, wherein said undulating surface includes an inclined portion, wherein an incline of said inclined portion rises in said sheet feed direction.

40. The imaging apparatus of claim 38, wherein said undulating surface is continuous in said main scan direction, and comprises a substantial portion of a surface area of said mid-frame.

41. The imaging apparatus of claim 38, wherein said mid-frame includes an opening for receiving waste ink, said undulating surface being located on each side of said opening in said sheet feed direction.

42. The imaging apparatus of claim 41 wherein said opening is an elongated slot, wherein said elongated slot is elongated in said main scan direction.

43. The imaging apparatus of claim 38, wherein said mid-frame comprises a first trough defining a first opening for collecting first waste ink not ejected on said print medium sheet, and a second trough spaced from said first trough in said sheet feed direction defining a second opening for collecting second waste ink not ejected on said print medium sheet.

44. The imaging apparatus of claim 43, further comprising a third trough spaced from said second trough in said sheet feed direction, said third trough defining a third opening for collecting third waste ink not ejected on said print medium sheet.

45. The imaging apparatus of claim 38, wherein said mid-frame includes a first opening spaced from a second opening in said sheet feed direction, said mid-frame comprising:

a base; and a partition extending upwardly from said base, wherein said first opening is separated from said second opening by said partition, and said partition defining a portion of said undulating surface.

46. The imaging apparatus of claim 45, wherein said portion is inclined in said sheet feed direction.

47. The imaging apparatus of claim 45, wherein said undulating surface is continuous in said main scan direction and is interrupted in said sheet feed direction by said first opening and said second opening.

48. The imaging apparatus of claim 46, wherein each of said first opening and said second opening extends beyond a width of said print medium sheet in said main scan direction.

49. The imaging apparatus of claim 38, wherein said mid-frame includes a first opening spaced from a second opening in said sheet feed direction, and a third opening spaced from said second opening in said sheet feed direction, said mid-frame comprising:

a base;

a first partition extending upwardly from said base, wherein said first opening is separated from said second opening by said first partition; and a second partition extending upwardly from said base, wherein said second opening is separated from said third opening by said second partition.

50. The imaging apparatus of claim 49, wherein at least one of said first opening, said second opening and said third opening extends beyond a width of said print medium sheet in said main scan direction.

51. The imaging apparatus of claim 49, wherein each of said first partition and said second partition define a portion of said undulating surface.

52. The imaging apparatus of claim 51, wherein said portion is inclined in said sheet feed direction.

53. The imaging apparatus of claim 51, wherein said portion of said undulating surface is continuous in said main scan direction.

54. The imaging apparatus of claim 38, wherein said continuous undulating surface has a substantially sinusoidal shape.

* * * * *